US005884381A

United States Patent [19]

Calusinski

[11] Patent Number: 5,884,381

[45] **Date of Patent: *Mar. 23, 1999**

[54] TOOL FOR REMOVING A RAILWAY FASTENING CLIP FROM A RAIL

[75] Inventor: Richard Robert Calusinski, Vista, Australia

[73] Assignee: Everts & Van Der Weijden Exploitatie Maatschappij Ewem B. V., Hoofdorp, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 811,680

[22] Filed: Mar. 5, 1997

Related U.S. Application Data

[63] Continuation-in-part of PCT/AU96/00453, Jul. 17, 1996.

[30] Foreign Application Priority Data

Jul. 18, 1995 [AU] Australia ..... PN4214

[51] Int. Cl.[6] ..... B23P 19/00

[52] U.S. Cl. ..... 29/426.6; 29/225; 29/229; 29/254

[58] Field of Search ..... 29/426.6, 243.56, 29/225, 229, 254, 426.5, 426.1, 505

[56] References Cited

U.S. PATENT DOCUMENTS

| | | | |
|---|---|---|---|
| 4,373,247 | 2/1983 | Holenstein et al. | 29/426.6 |
| 5,020,202 | 6/1991 | Turrell | 29/243.56 |
| 5,392,504 | 2/1995 | Calusinski | 29/426 |
| 5,661,886 | 9/1997 | Smith | 29/243.56 |

FOREIGN PATENT DOCUMENTS

| | | |
|---|---|---|
| 55329/80 | 8/1980 | Australia . |
| B 13215/83 | 10/1983 | Australia . |
| 1 514 199 | 6/1978 | United Kingdom . |
| 1 520 917 | 8/1978 | United Kingdom . |
| 2 027 778 | 2/1980 | United Kingdom . |
| WO 93/00478 | 1/1993 | WIPO . |

*Primary Examiner*—Frances Han
*Attorney, Agent, or Firm*—Perman & Green LLP

[57] ABSTRACT

A tool for removal of a clip retained on a railway rail, the tool being characterised by:

a forward claw adapted to engage the retained rail clip beneath a forward portion of the clip and a rearward claw adapted to bear against a rearward portion of a rail shoulder, the forward and rearward claws being spaced apart and co-operating to grip the clip therebetween; and a lever connected to the rearward claw, the rearward claw being rotated in response to a rotation of the lever, the lever and rearward claw being rotatable with respect to the forward claw about an axis transverse to the clip and substantially parallel to the railway rail; and a wedge located between the forward and rearward claws being arranged so as to receive and engage the clip therein;

whereby, in use, a rotation of the lever produces a corresponding rotation of the rearward claw bringing the forward claw into engagement with the clip and urging the clip forwards such that the outer edges of the clip are compressed by the wedge to allow the clip to pass through a gate retaining the clip in position.

12 Claims, 5 Drawing Sheets

TOOL FOR REMOVING A RAILWAY FASTENING CLIP FROM A RAIL

This application is a continuation-in-part of copending application International Application PCT/AU96/00453 filed on Jul. 17, 1996 and which designated the United States.

1. Technical Field

The present invention relates to a tool for removing a railway fastening clip from a rail and to a method for removing a rail fastening clip on a rail using such a tool.

2. Background Art

Rail clips such as those shown in British patent number 1 217 531 have been used for many years. These clips are installed into shoulders along side the rail either manually, for example using a sledge hammer to drive the clip into the shoulder, or automatically by a clip driving machine.

From time to time, for example for maintenance purposes, it may become necessary to remove the clips from the rail. Removing a clip from a rail is typically a manual operation and, has been achieved using a combination of a wedge and hammer as exemplified in U.S. Pat. No. 5,392,504. In this patent a sliding impact hammer is used to drive a wedge onto the fastened clip, thereby compressing the sides of the clip forcing the clip through the gate on the rail shoulder. As the clip passes through the gate the clip is released from the compressed stage and can move outwardly from the rail with some speed. The removal action is therefore not a controlled action.

The present invention seeks to provide an alternative tool in which the removal of the clip is controlled and occurs in a smooth process.

DISCLOSURE OF THE INVENTION

Therefore according to one aspect of the present invention, although this need not be the broadest nor indeed the only aspect, there is provided a tool useful for removal of a clip retained on a railway rail, the tool comprising:

- a forward claw adapted to engage the retained rail clip beneath a forward portion of the clip and a rearward claw adapted to bear against a rearward portion of a rail shoulder, the forward and rearward claws being spaced apart and cooperating to grip the clip therebetween;
- a lever connected to the rearward claw, the rearward claw being rotated in response to a rotation of the lever, the lever and rearward claw being rotatable with respect to the forward claw about an axis transverse to the clip and substantially parallel to the railway rail; and
- a cross member located between the forward claws, the cross member including a recess therein, a front portion of the clip being receivable in the recess, the recess including outer walls which are angled to produce a narrowing of the recess towards the front of the tool;
- whereby, in use, a rotation of the lever produces a corresponding rotation of the rearward claw bringing the forward claw into engagement with the clip and urging the clip forwards such that the outer edges of the clip are compressed by the outer walls of the recess to enable the clip to pass through the gate retaining the clip.

By gripping the front portion of the clip in this way and using the rear end of the rail shoulder as a fulcrum point for the lever, it is possible to lift the clip away from its retained position into the wedge. The wedge acts to compress the clip and as the clip moves through the gate the clip is retained within the tool. The removal action is therefore a relatively smooth action compared with the prior art techniques which essentially rely on impact to release the clip.

Preferably, a pair of the forward and rearward claws are connected by a bridging element, the bridging elements being located on either sides of the clip in use. Preferably, the forward claw is integrally formed with the wedge. Advantageously, the wedge and forward claw are shaped such that the forward claw comprises a small tooth like projection on an underside of the wedge, the forward claw being inclined towards the clip to thereby engage the clip.

In an alternative embodiment the forward and rearward claws act through the centre of the clip and are connected by a generally centrally located bridging element.

Preferably, the cross member includes a pair of recesses, a respective limb of the rail clip being received in a respective recess in the wedge; the recesses each including an angled inner wall, and the inner wall serving to compress the clip as the clip is brought into engagement with the wedge as a result of rotation of the rearward claw by the lever. Thus, by driving the clip against the wedge and pulling backwards on the lever, the tool of the present invention is able to lever the compressed clip through the gate in a single action; the action not requiring a great degree of force to complete.

Further, in a preferred embodiment of the invention, the tool is adapted to grip the clip and its associated shoulder element using forward and rearward claws which contact the clip at only the lowermost front edge and the shoulder at the lowermost rear edge of the shoulder. There is therefore only a small area of contact between the clip and the removal tool. However, the tool is able to apply force at an appropriate position to remove the clip quickly from the rail.

Preferably, the tool further comprises a resilient shock absorbing member extending between the rearward claws, the shock absorbing member serving to collect and retain a released clip, thereby preventing the clip from escaping at speed causing damage.

It is also advantageous if an outer edge of the rearward claws has a curved surface thereby permitting an uninterrupted rotational movement of the claw over a rail shoulder surface in use.

According to a further aspect of the present invention there is provided a method of removing a railway clip from a retained position on a rail, the method comprising the steps of:

(a) providing a tool having
  - a forward claw adapted to engage the retained rail clip beneath a forward portion of the clip and a rearward claw adapted to bear against a rearward portion of a rail shoulder, the forward and rearward claws being spaced apart and cooperating to grip the clip therebetween;
  - a lever connected to the rearward claw, the rearward claw being rotated in response to a rotation of the lever, the lever and rearward claw being rotatable with respect to the forward claw about an axis transverse to the clip and substantially parallel to the railway rail; and
  - a cross member located between the forward claws, the cross member including a recess therein, a front portion of the clip being receivable in the recess, the recess including outer walls which are angled to produce a narrowing of the recess towards the front of the tool;

(b) engaging the tool on a clip retained on a railway rail by passing the forward claw over a forward portion of the clip and the rearward claw over a rearward portion of the clip;

(c) rotating the lever to produce a corresponding rotation of the rearward claw thereby bringing the forward claw into engagement with the clip and urging the clip forwards such that the outer edges of the clip are compressed by the wedge to allow the clip to pass through a gate retaining the clip in position.

BRIEF DESCRIPTION OF THE DRAWINGS

The present invention will now be described, by way of the following non-limiting example, with reference to accompanying drawings in which.

DESCRIPTION OF PREFERRED EMBODIMENT

Figure 1:
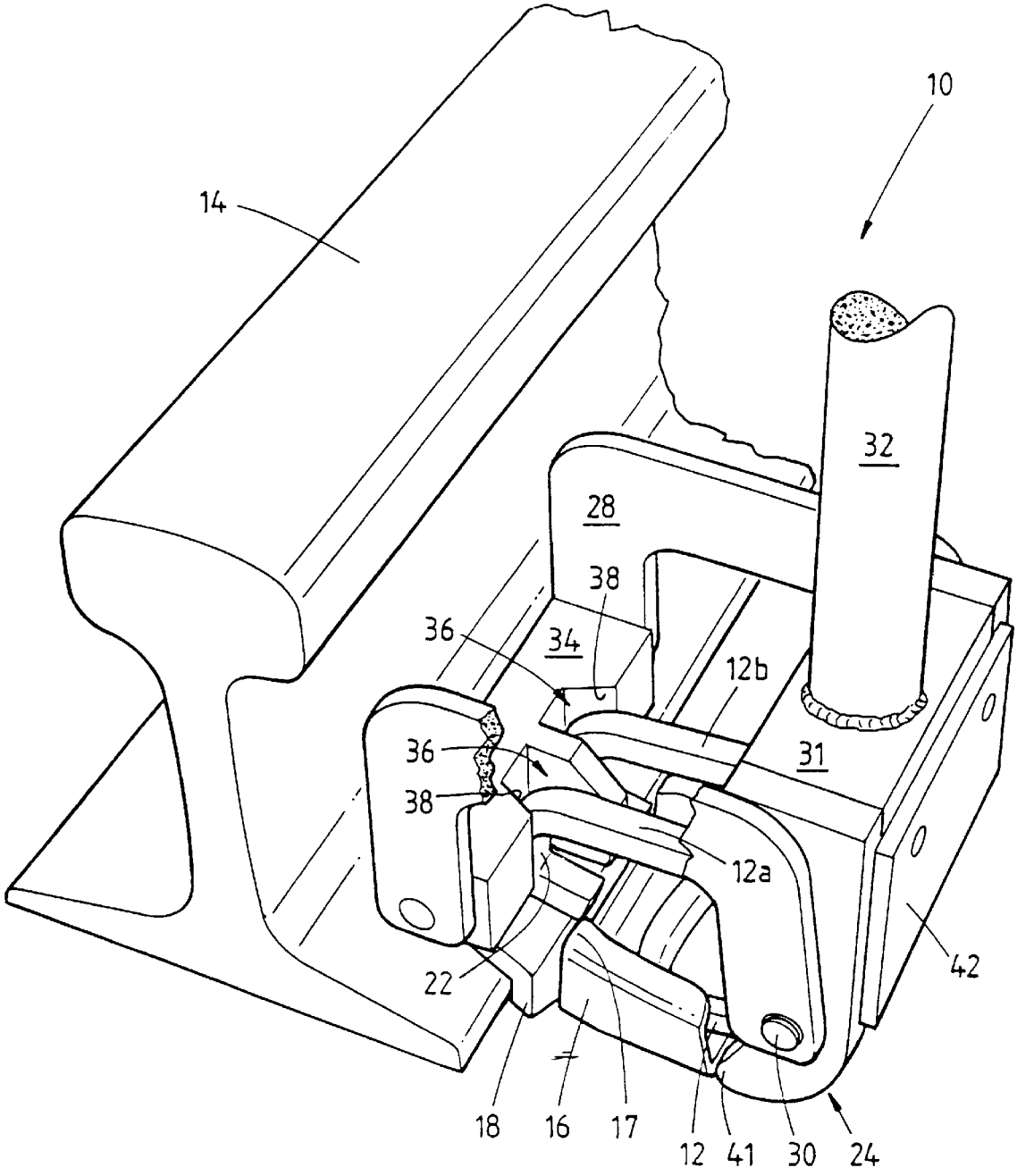
FIG. 1 represents in perspective view a tool for removal of a clip retained on a railway rail in accordance with one aspect of the present invention.

Shown in the drawing is a tool 10 for removing a railway fastening clip 12 from a retained position on a railway rail 14. The clip 12 comprises a pair of spaced C shaped limbs 12*a*, 12*b* arranged with the open face of the C placed downwards. The clip 12 is retained on the rail 14 by compressing the limbs 12*a*, 12*b* of the clip until a front portion of the limbs pass through a gate in a shoulder 16. The relationship between the limbs 12*a*, 12*b* and the shoulder 16 is shown most clearly in the schematic cross sectional views of FIG. 4 and FIG. 5. An upper section 17 of the shoulder 16 forms a gate through which the limbs 12*a*, 12*b* must pass to allow the clip 12 to be removed from the rail 14. The front portion of the clip 12 rests on an insulator 18.

The arrangement of the clip 12, rail 14, shoulder 16 and insulator 18 is a conventional arrangement and is used in many places throughout the world. In alternative arrangements the insulator 18 is not required. In such situations the tool 10 of the present invention is equally useful for clip removal.

The tool 10 comprises a forward claw 20 adapted to engage the rail clip 12 beneath a forward portion 22 of the clip 12, and a pair of spaced rearward claws 24 adapted to bear against a rear portion 26 of the rail clip 12. The forward claw 20 and rearward claws 24 are connected by a pair of spaced U-shaped bridging portions 28. The bridging portions 28 are located at either side of the clip 12, thus the forward claw 20, rearward claws 24 and bridging portions 28 serve to enclose the clip 12. The rearward claws 24 are pivotally mounted to each of the U-shaped bridging portions 28 at pivot points 30. As can be seen from the drawings, the pivots 30 are arranged such that the tool 10 is rotated about an axis transverse to the clip and substantially parallel to the rail direction. In FIG. 1 a section of one bridging portion 28 has been cutaway to allow a better view of the clip 12 and its relationship with the tool 10.

The rearward claws 24 are connected by a plate 31 extending between upper ends thereof, a lever 32 extending generally upwardly from the plate 31. The lever 32 is securely welded to the plate 31. The lever 32 terminates in a handle not shown. The outer edge of the rearward claw 24 has a curved surface to allow a rocking movement of the tool 10 on the claws 24.

Figure 2:
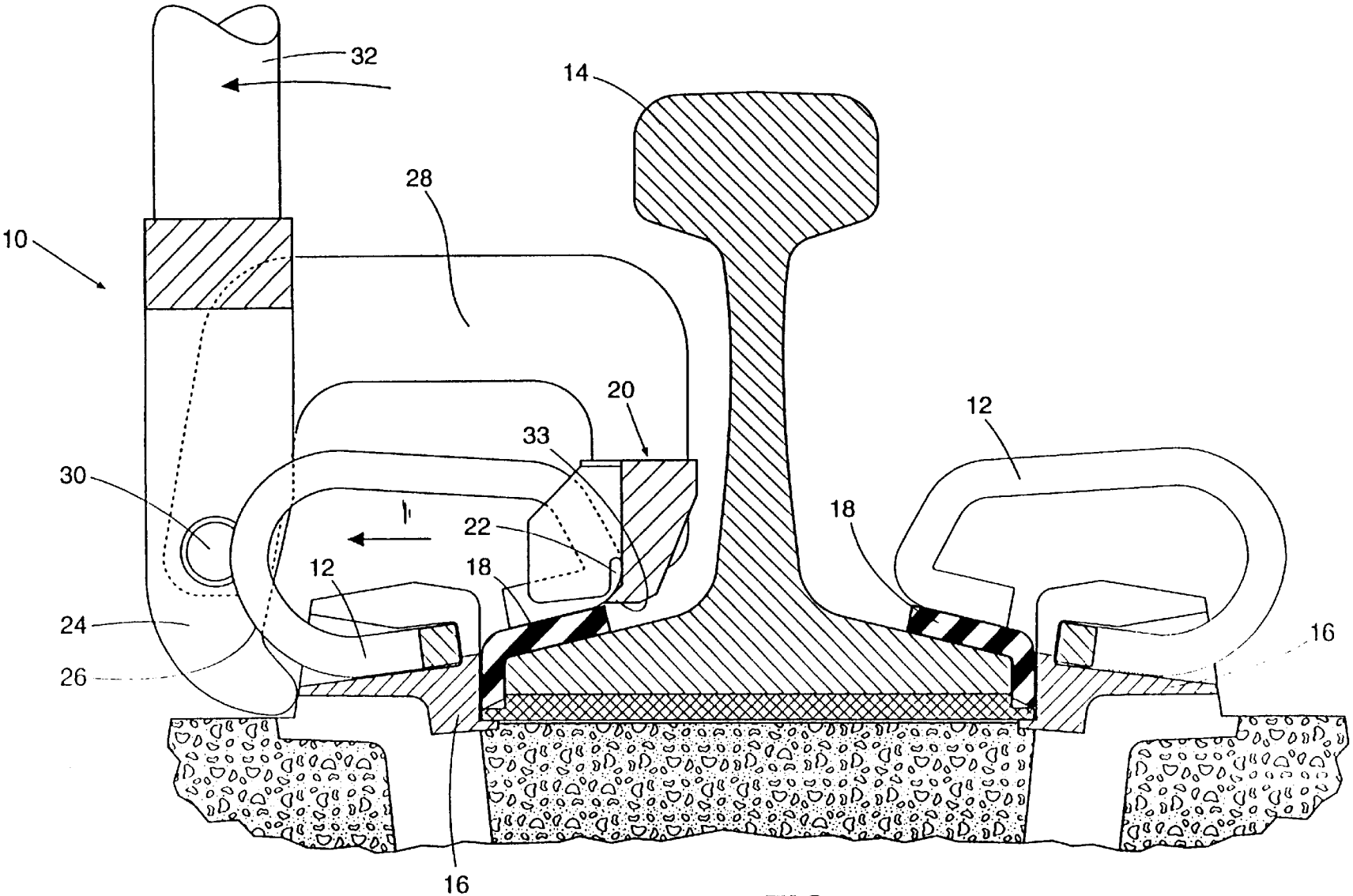
FIG. 2 illustrates in vertical cross-sectional view the tool and rail clip of FIG. 1.
Figure 3:
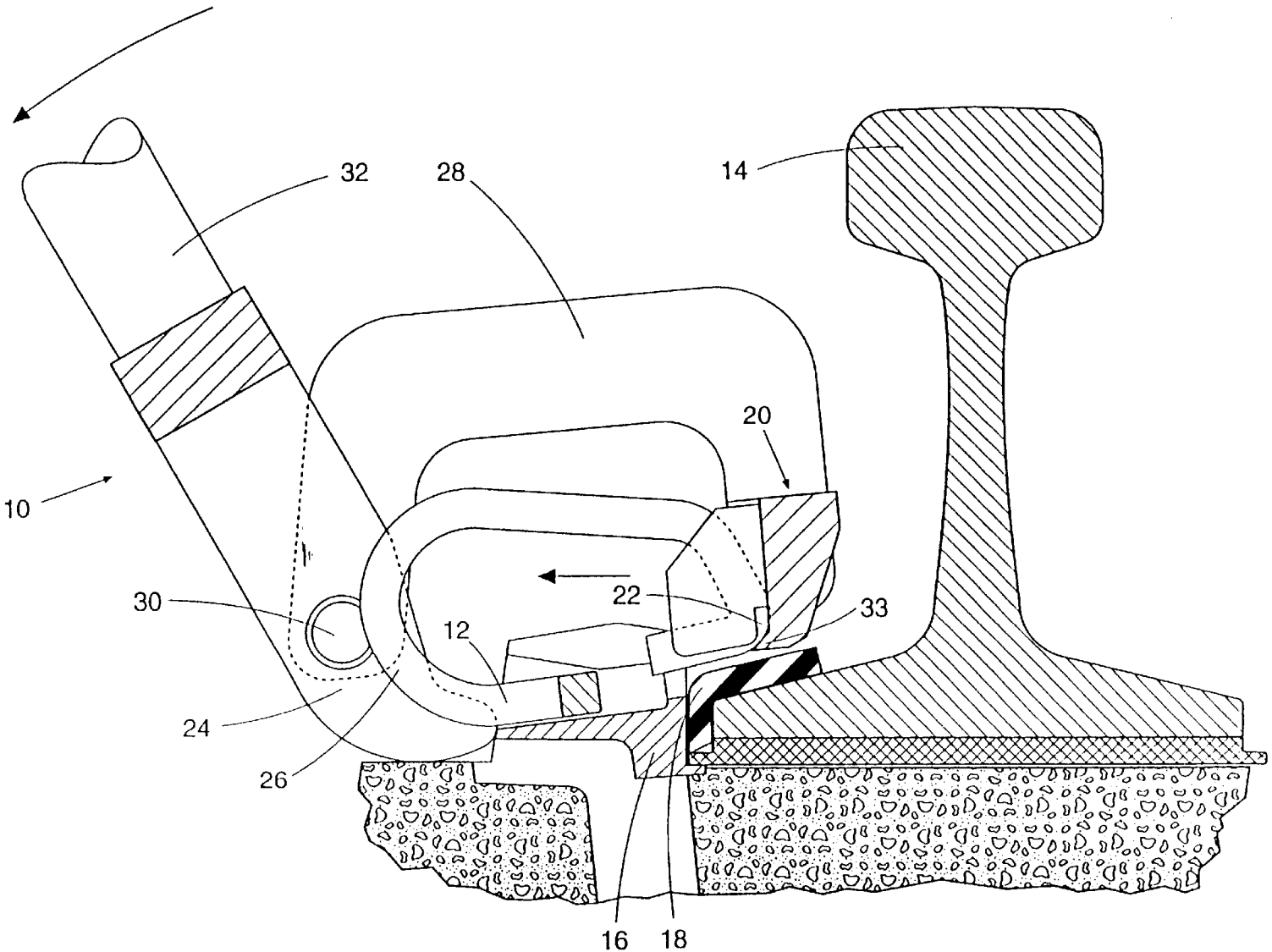
FIG. 3 illustrates in side cross-sectional view the tool and rail clip of FIG. 1 with the clip in a partially removed position.

The forward claw 20 comprises a cross member 34 fixed between sections of the bridging portions 28, and includes a small tooth portion 33 projecting downwardly from a lowermost part of the cross member 34. The tooth portion 33 is slightly angled towards the centre of the tool 10 allowing the tooth 33 to catch under the clip 12 as shown in FIGS. 2 and 3 thereby engaging the front portion 22 of the clip 12. The wedges 34 and forward claw 20 are, as can been seen, capable of being formed as one unit.

Figure 5:
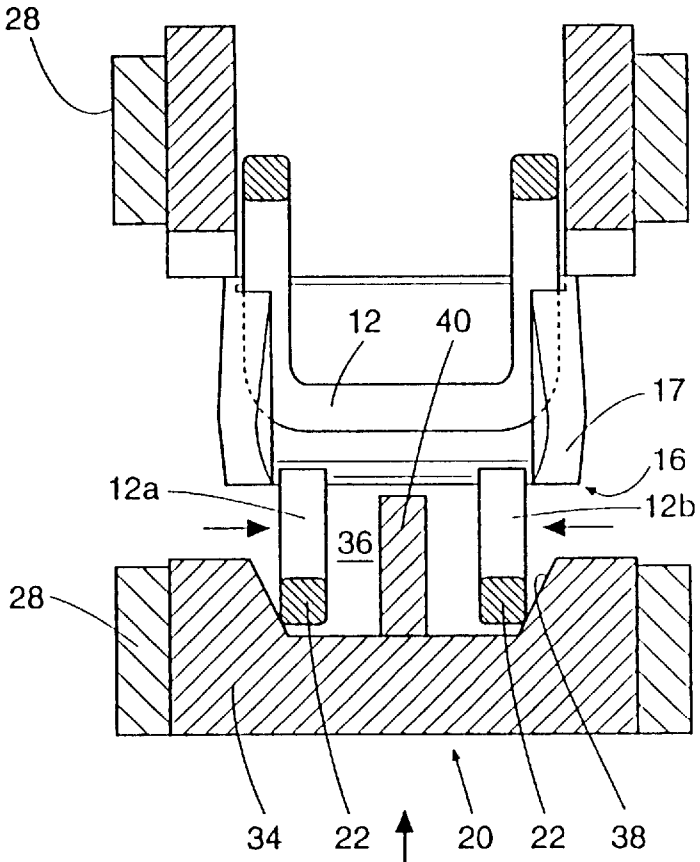
FIG. 5 illustrates in horizontal cross section the clip and tool in the position shown in FIG. 3.

As can be seen in FIG. 1 each of the limbs 12*a*, 12*b* of the front portion 22 of the clip 12 are received in a respective recess 36 in the cross member 34. Each recess 36 has one outermost inclined wall 38. The inclined wall 38 ensures that the recesses 36 are wider towards the centre of the tool 10 and narrower towards the front of the tool 10. The recesses 36 are situated such that the in position, the limbs 12*a*, 12*b* of the clip 12 bear against the inclined wall 38; whereby, as the clip 12 is urged into the recesses 36 the outermost edges of the limbs 12*a*, 12*b* are compressed as the tool 10 is moved into engagement with the clip 12. Sufficient compression of the limbs 12*a*, 12*b* towards one another allows the clip to pass through the gate in the shoulder 16. The effect of the urging of the limbs 12*a*, 12*b* of the clip 12 into the recesses 36 is illustrated most clearly in FIGS. 4 and 5. As the limbs 12*a*, 12*b* move into the recesses 36 there is a corresponding compression of the limbs 12*a*, 12*b* narrows the clip into allow passage through the shoulder 16 as shown in FIG. 5.

A centre portion 40 separates each limb of the clip 12, although it will be appreciated that the tool 10 may be formed without the portion 40.

The forward claw 20 goes around against a lowermost front corner of the clip 12 and shoulder 16 as can be seen in FIG. 3.

The rearward claws 24 comprise a pair of flattened elongate sections spaced apart, each section terminating in a rounded projecting lip 41 adapted to bear against an outermost section of the shoulder 16 as shown in FIG. 3. In alternative embodiments, the claws 24 bear on an inner portion of the shoulder 12.

A resilient shock absorbing section 42 extends between each of the rearward claw sections 24, the shock absorbing section 42 forming an outer face of the tool 10. The resilient element 42 being adapted to catch a clip 12 as it is removed from a retained position and to prevent any unwanted outward movement of the clip 12.

In use, the tool 10 is placed over a retained clip 12 as shown in FIG. 1. The forward claw 20 engages the lowermost front corner of the clip 12 and as shown in FIG. 2 and the limbs 12*a*, 12*b* of the clip are retained in the recesses 36 in the wedge 34 as shown in FIG. 4.

Figure 4:
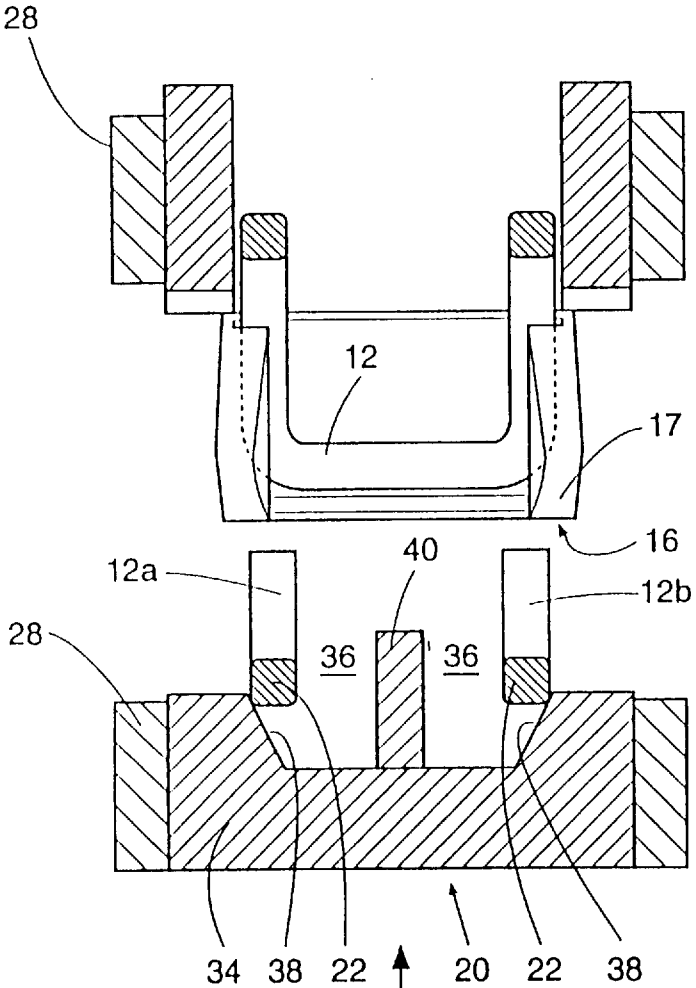
FIG. 4 illustrates in a horizontal cross section the clip and tool in the position shown in FIG. 2.
Figure 6:
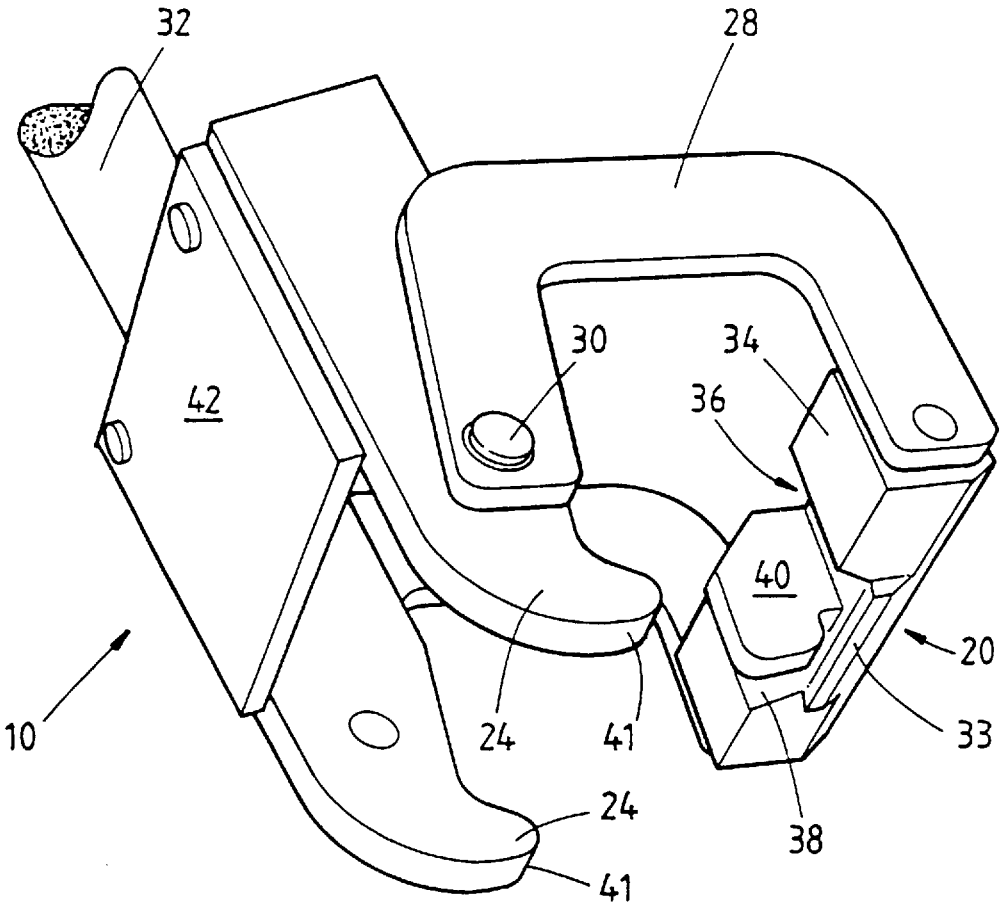
FIG. 6 illustrates in perspective view an underside view of the tool of FIG. 1.

As will be appreciated from FIG. 4, the limbs of the clip 12, if moved backwards, would impinge against the shoulder 16 and therefore the clip would not be in a position to move.

The lever 32 and the rearward claw 24 are rotated around the pivot 30 so as to bring the front portions of the rearward claw 24 into contact with a lowermost outermost portion of the shoulder 16 as shown in FIG. 3. The clip 12 is therefore urged into the recesses 34 and the outer walls 38 of each recess bear against the outer limbs of the clip 12 thereby compressing the clip 12 as shown in FIG. 5. It can be clearly appreciated from FIG. 5 that in the compressed condition the limbs 12*a*, 12*b* of the clip 12 are able to pass through the shoulder 16 and therefore the clip 12 can be released from the retained position to a removed position. Thus, continued rotation of the lever 32, effectively lifts the clip 12 through the gate in the shoulder 16 removing the clip 12 from the retained position.

As the clip 12 moves out of the retained position the resilient member 42 collects the clip 12 and prevents any unwanted flying away of the clip 12. Therefore, the tool 10 of the present invention allows a single operator to release a retained clip in a smooth operation without the need for application of excessive force.

Modifications and variations of the present invention such as will be apparent to a skilled addressee are deemed to be within the scope of the present invention. In particular, it should be noted that the specific shape of railway clip used to describe the operation of the present invention is but one example of a large number of shapes of clip that are known and used. Therefore, it is within the scope of the present invention to make such alterations to a removal tool as are required to permit operation of the tool with a number of clip geometries.

I claim:

1. A tool useful for removal of a clip retained on a railway rail by having outer edges of the clip retained outside of a gate, the tool including:

a forward claw adapted to engage the retained rail clip beneath a forward portion of the clip and a rearward claw adapted to bear against a rearward portion of a rail shoulder, the forward and rearward claws being spaced apart and co-operating to grip the clip therebetween;

a lever connected to the rearward claw, the rearward claw being rotated in response to a rotation of the lever, the lever and rearward claw being rotatable with respect to the forward claw about an axis transverse to the clip and substantially parallel to the railway rail;

a cross member located between the forward claws, the cross member including a recess therein, a front portion of the clip being receivable in the recess the recess including outermost inclined walls which are wide towards the center of the tool and narrow towards the front of the tool; and whereby, in use, a rotation of the lever produces a corresponding rotation of the rearward claw bringing the forward claw into engagement with the clip and urging the clip forwards such that the clip is compressed by the outer walls of the recess to enable the clip to pass through the gate retaining the clip.

2. A tool according to claim 1, wherein in that the rearward portion of the rail shoulder serves as a fulcrum point for the lever, thereby permitting the lifting of the clip away from its retained position into the wedge.

3. A tool according to claim 1, the tool further comprising a forward and a pair of rearward claws, each of the forward and rearward claws being connected by a bridging element, the bridging elements being located on either sides of the clip in use.

4. A tool according to claim 1, wherein the forward and rearward claws act through the center of the clip and are connected by a generally centrally located bridging element.

5. A tool according to claim 1, the recess being divided by a centrally located dividing wall into two separate recesses, each recess receiving a respective limb of the clip therein.

6. A tool according to claim 1, in which the tool is adapted to grip the clip using forward and rearward claws which contact the clip at only the lowermost front edge and the shoulder at the lowermost rear edge of the shoulder.

7. A tool according to claim 1, wherein the forward claw includes a tooth-like projection located on an underside of the claw, the projection being inclined towards the rearward claw and serving as a means of contact for engaging the front portion of a retained clip.

8. A tool according to claim 1, in which the rearward claw comprises a pair of flattened elongate sections spaced apart, each section terminating in a rounded projecting lip adapted to bear against an outermost section of a rail shoulder, and wherein the tool is able to be rotated on the outer surface of the rearward claws.

9. A tool according to claim 1, the tool further comprising a resilient shock absorbing member extending transversely of the clip and tool, the shock absorbing member being able to capture and restrain a clip released from a retained position by the tool.

10. A method of removing a railway clip from a retained position on a rail, the method comprising the steps of:

(a) providing a tool having a forward claw adapted to engage the retained rail clip beneath a forward portion of the clip and a rearward claw adapted to bear against a rearward portion of a rail shoulder, the forward claw and rearward claw being spaced apart and cooperating to grip the clip therebetween;

a lever connected to the rearward claw, the rearward claw being rotated in response to a rotation of the lever, the lever and rearward claw being rotatable with respect to the forward claw about an axis transverse to the clip and substantially parallel to the railway rail;

a cross member located between the forward claws, the cross member including a recess therein, a front portion of the clip being receivable in the recess, the recess including outermost inclined walls which are wide towards the center of the tool and narrow towards the front of the tool;

(b) engaging the tool on a clip retained on a railway rail by passing the forward claw over a forward portion of the clip and the rearward claw over a rearward portion of the clip; and (c) rotating the lever to produce a corresponding rotation of the rearward claw thereby bringing the forward claw into engagement with the clip and urging the clip forwards such that the outer edges of the clip are compressed by the outer walls of the recess to enable the clip to pass through the gate retaining the clip.

11. A tool useful for removal of a clip retained on a railway rail by having outer edges of the clip retained outside of a gate, the tool including:

a forward claw adapted to engage the retained rail clip beneath a forward portion of the clip and a rearward claw adapted to bear against a rearward portion of a rail shoulder, the forward and rearward claws being spaced apart and co-operating to grip the clip therebetween;

a lever connected to the rearward claw, the rearward claw being rotated in response to a rotation of the lever, the lever and rearward claw being rotatable with respect to the forward claw about an axis transverse to the clip and substantially parallel to the railway rail, said lever being located relative to the rail shoulder so as to act against a portion thereof when rotated; and a cross member located between the forward claws, the cross member including a recess therein, a front portion of the clip being receivable in the recess the recess including outermost inclined walls which are wide towards the center of the tool and narrow towards the front of the tool;

whereby, in use, a rotation of the lever acting against the rail shoulder produces a corresponding rotation of the rearward claw bringing the forward claw into engagement with the clip and urging the clip forwards such that the clip is compressed by the outer walls of the recess to enable the clip to pass through the gate retaining the clip.

12. A method of removing a railway clip from a retained position on a rail, the method comprising the steps of:

(a) providing a tool having a forward claw adapted to engage the retained rail clip beneath a forward portion of the clip and a rearward claw adapted to bear against a rearward portion of a rail shoulder, the forward claw and rearward claw being spaced apart and cooperating to grip the clip therebetween; and a lever connected to the rearward claw, the rearward claw being rotated in response to a rotation of the lever, the lever and rearward claw being rotatable with respect to the forward claw about an axis transverse to the clip and substantially parallel to the railway rail, said lever being located relative to the rail shoulder so as to act against a portion thereof when rotated;

a cross member located between the forward claws, the cross member including a recess therein, a front portion of the clip being receivable in the recess, the recess including outermost inclined walls which are wide towards the center of the tool and narrow towards the front of the tool;

(b) engaging the tool on a clip retained on a railway rail by passing the forward claw over a forward portion of the clip and the rearward claw over a rearward portion of the clip; and (c) rotating the lever against the rail shoulder to produce a corresponding rotation of the rearward claw thereby bringing the forward claw into engagement with the clip and urging the clip forwards such that the outer edges of the clip are compressed by the outer walls of the recess to enable the clip to pass through the gate retaining the clip.

* * * * *